US007766185B2

(12) United States Patent
Herbert

(10) Patent No.: US 7,766,185 B2
(45) Date of Patent: Aug. 3, 2010

(54) DETACHABLE SPILL GUARD FOR A BLENDER CUP OR OTHER CONTAINER

(75) Inventor: J. Michael Herbert, Winchester, MA (US)

(73) Assignee: Island Oasis Frozen Cocktail Company, Inc., Walpole, MA (US)

( * ) Notice: Subject to any disclaimer, the term of this patent is extended or adjusted under 35 U.S.C. 154(b) by 523 days.

(21) Appl. No.: 11/599,822

(22) Filed: Nov. 15, 2006

(65) Prior Publication Data

US 2007/0158353 A1 Jul. 12, 2007

Related U.S. Application Data

(60) Provisional application No. 60/758,134, filed on Jan. 11, 2006.

(51) Int. Cl.
*A47G 19/22* (2006.01)

(52) U.S. Cl. ..... 220/719

(58) Field of Classification Search ..... 220/642, 220/655, 731, 704, 716–718, 733, 734, 719, 220/270; 229/404
See application file for complete search history.

(56) References Cited

U.S. PATENT DOCUMENTS

| | | | | | |
|---|---|---|---|---|---|
| 440,541 | A * | 11/1890 | Chandler | 220/704 |
| 3,800,999 | A * | 4/1974 | Serritella | 229/404 |
| 3,858,767 | A * | 1/1975 | Bonin | 222/494 |
| 4,285,442 | A * | 8/1981 | Wedzik | 220/270 |
| 4,681,030 | A | 7/1987 | Herbert | |
| 5,618,106 | A * | 4/1997 | Madera | 366/130 |
| 6,095,677 | A | 8/2000 | Karkos, Jr. et al. | |
| 6,324,313 | B1 | 11/2001 | Allman et al. | |
| 6,595,394 | B1 * | 7/2003 | Savala | 222/189.07 |
| 7,275,652 | B2 * | 10/2007 | Morris et al. | 220/212 |

* cited by examiner

*Primary Examiner*—Anthony Stashick
*Assistant Examiner*—Harry A Grosso
(74) *Attorney, Agent, or Firm*—Lando & Anastasi, LLP

(57) ABSTRACT

A spill guard device for preventing unwanted spillage of material from a container. The device comprises a body shaped to fit on the rim of the container, the body having a U-shape in cross-section, and having a flange extending inwardly and adjacent the spout of the container, the flange preventing the material from spilling from the container as it is poured out via the spout. A notch in the underside of the body cooperates with a ridge formed on the exterior of the container, parallel and adjacent to the rim, to secure the device on the rim in proper location.

12 Claims, 3 Drawing Sheets

DETACHABLE SPILL GUARD FOR A BLENDER CUP OR OTHER CONTAINER

CROSS-REFERENCE TO RELATED APPLICATION

This application claims the priority of U.S. Provisional Patent Application Ser. No. 60/758,134, filed on Jan. 11, 2006, now pending, which is hereby incorporated by reference in its entirety into this specification.

BACKGROUND OF THE INVENTION

When drinks having a high viscosity, such as smoothies and frozen drinks, are poured from a blender cup or other container into smaller containers or glassware, the "thick" liquid tends to flow slowly. If the blender cup is tipped at an angle that will cause a faster flow, the liquid will pour out from a wider area at the front of the blender cup and may spill around, rather than into, the smaller container or glassware. The device of the instant invention is intended to prevent such spills. It is particularly helpful when used, for instance, in connection with an apparatus for preparing frozen drinks utilizing an ice dispensing machine and a blender having a blender cup for receipt of the drink ingredients and the dispensed ice, such as those shown in U.S. Pat. No. 4,681,030 entitled "Apparatus for Making Frozen Drinks," and U.S. Pat. No. 6,095,677 entitled "Magnetic Drive Blender," both owned by Island Oasis Frozen Cocktail Company, Inc., of Walpole, Mass.

SUMMARY OF THE INVENTION

This invention relates to a device for preventing unwanted spills while pouring liquid or other material from a container, and particularly to a device that may be securely and removably affixed to the rim of the container to permit the liquid or other material to be poured into a receptacle such as a glass, without the material spilling out around instead of pouring into the receptacle.

BRIEF DESCRIPTION OF THE DRAWINGS

The following description of the invention will be more fully understood with reference to the accompanying drawings in which.

DETAILED DESCRIPTION OF THE INVENTION

Figure 1:
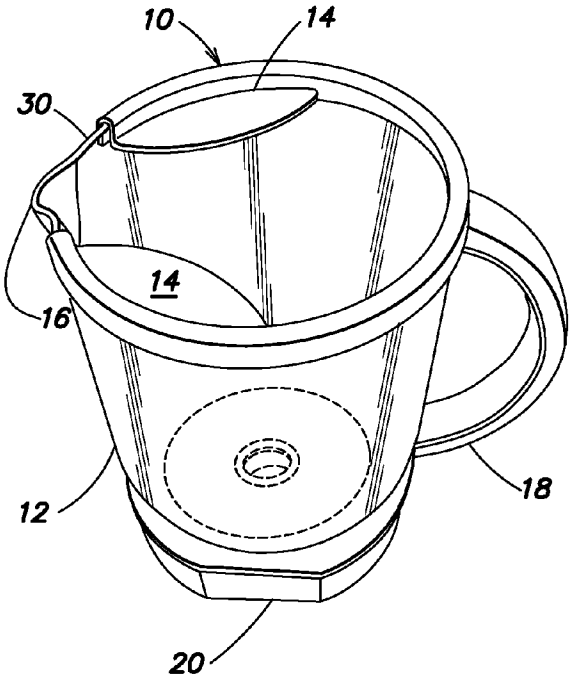
FIG. 1 is a perspective view of a spill guard device according to the instant invention, mounted on the rim of a blender cup.
Figure 2:
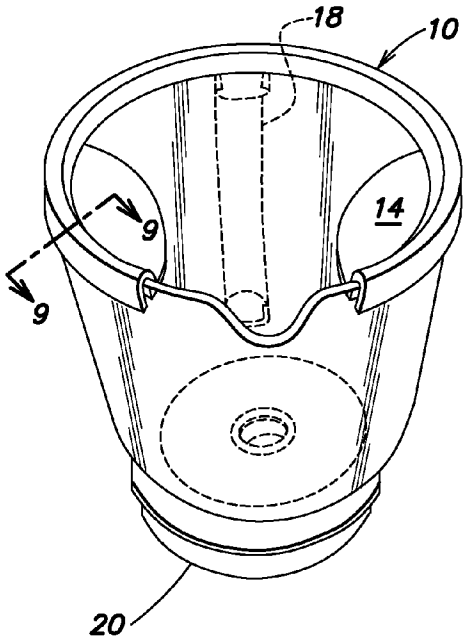
FIG. 2 is a view of the blender cup of FIG. 1, looking toward the spout of the blender cup.

FIGS. 1 and 2 depict a spill guard device 10 according to the instant invention, mounted on the top rim 30 of blender cup 12, which is here shown as having translucent sides. The top of the blender cup is open (see FIG. 4), except that flanges 14 of device 10, located adjacent spout 16, project inwardly to restrict the flow of liquid or other material as it is poured from the cup. Also shown in FIG. 1 are blender cup handle 18 and base 20.

Figure 3:
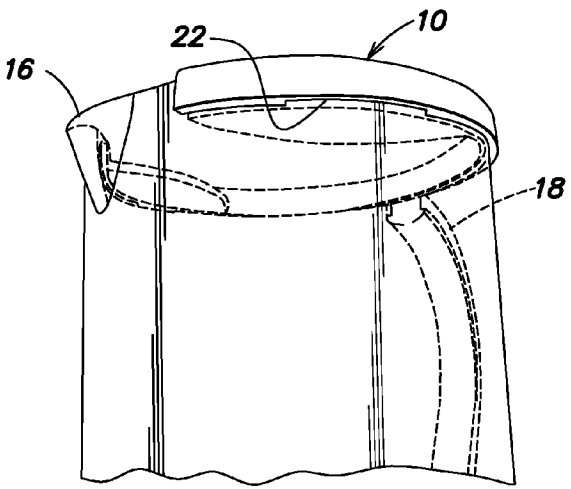
FIG. 3 is a view looking upward at the underside of the spill guard device, from the right side of FIG. 2.
Figure 4:
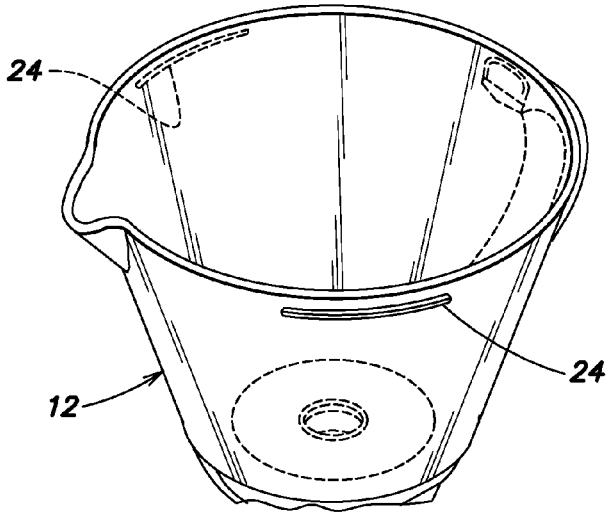
FIG. 4 is a view from one side of the blender cup of FIG. 1, with the spill guard device removed.
Figure 5:
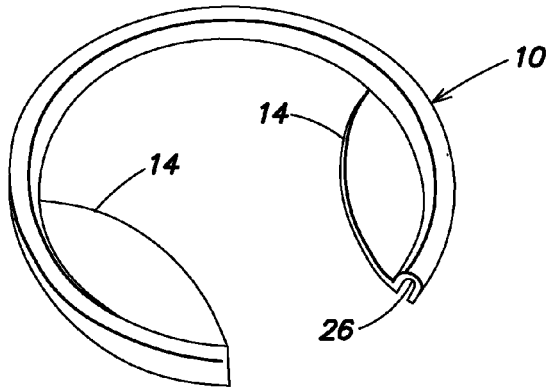
FIG. 5 is a perspective view of the spill guard device, as seen from above.

Turning to FIGS. 3 and 4, the underside of spill guard device 10 includes notches or cut-out areas 22 that mate with ridges 24 running parallel to and located just below the rim of the cup, on either side of blender cup 12, As the device is fitted onto the rim of the cup, the ridges 24 and notches 22 ensures that spill guard device 10 is properly situated and fits snugly and securely on the blender cup.

Figure 8:
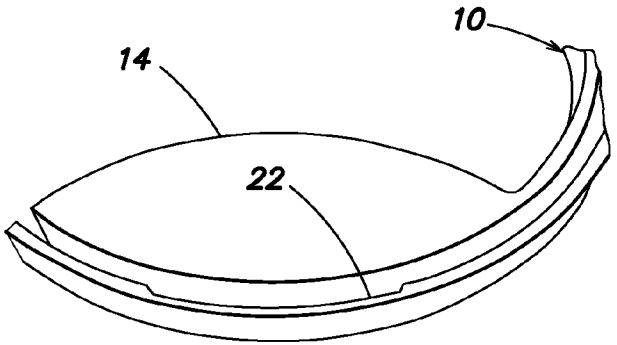
FIG. 8 is a close-up view of a portion of the underside of the spill guard device.
Figure 10:
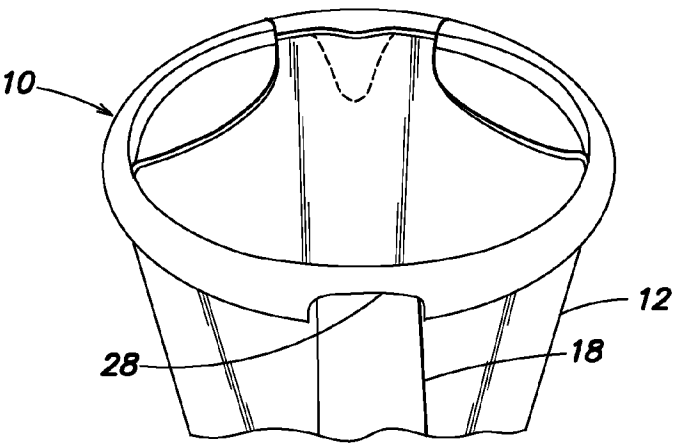
FIG. 10 is a perspective view of the rear of the blender cup, showing the spill guard device affixed to the rim and notched to fit over the blender cup handle
Figure 9:
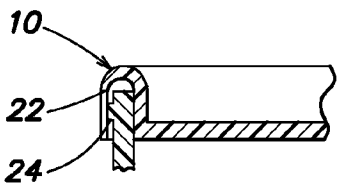
FIG. 9 is a cross-sectional view of the spill guard device along the line 10-10 of FIG. 2.

As seen in FIGS. 5 through 9, the spill guard device 10 has a U-shaped lower edge 26 that fits over the rim 30 of blender cup 12. The lower edge 26 includes notches 22 that correspond with ridges 24, as discussed above. Perhaps as best seen in FIGS. 8 and 9, these notches are directed radially outwardly and extend a short distance along the circumference of spill guard device 10. In FIG. 9 can be seen a cross-sectional view showing ridge 24 of the blender cup nestled within notch 22 of spill guard device 10. The inclusion of these ridges 24 on the side of the cup that mate with notches 22 on the underside of the device is optional.

Figure 6:
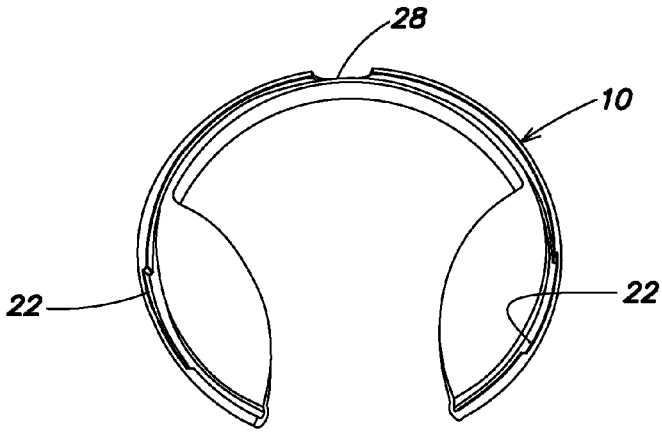
FIG. 6 is perspective view of the underside of the spill guard device.
Figure 7:
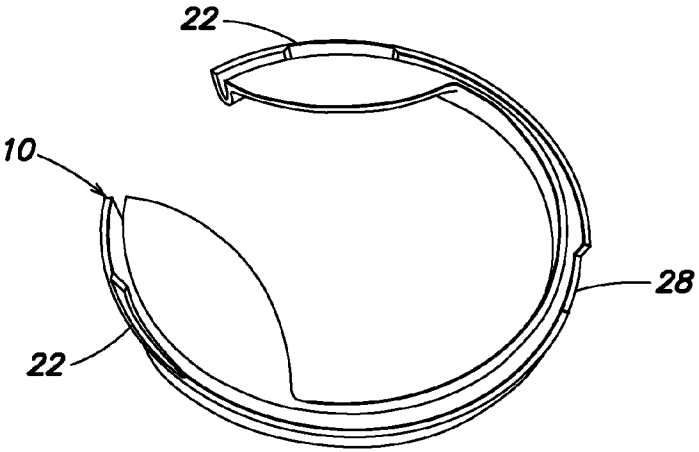
FIG. 7 is another perspective view of the underside of the spill guard device.

Finally, FIGS. 6 and 7 show a cut-out area 28 formed at the back edge of spill guard device 10, which allows spill guard device 10 to fit around handle 18 of blender cup 12. Of course, this particular cut-out section may not be needed with a cup having a different handle design.

It is important that the flanges on the spill guard device are not too large so that they do not hinder the making of a smoothie or frozen drink. For example, if the blender cup is used in connection with the making of a drink using the machine depicted in U.S. Pat. No. 6,324,313 (incorporated herein by reference), there must be an opening that will allow introduction into the cup of the ingredients of the drink, including the shaved ice delivered by the machine. The device of the instant invention may be positioned on the top rim of the blender cup before the cup is introduced into the drink making machine and may remain on the cup throughout the making and pouring of the drink, because it leaves ample room for the introduction of the flavoring ingredients and the delivery of the shaved ice by the machine. When desired, the device may be readily removed from the blender cup to facilitate cleaning.

The particular embodiment of the spill guard device here described is made from plastic, and is fairly rigid. Other materials, such as rubber, might be employed instead. The device here shown is approximately 6 inches in its outer diameter and about one-half inch in height. The groove on the underside of the device is about $\frac{1}{8}^{th}$ inch wide and about ⅜ths inch deep. The opening between the flanges at the front of the device is about 2 and ½ inches wide.

The foregoing description is intended primarily for purposes of illustration. This invention may be embodied in other forms or carried out in other ways without departing from the spirit or scope of the invention.

What is claimed:

1. A device for preventing unwanted spillage of material as it is poured from a container that has an upper rim and a spout, comprising a body having the general shape of the rim and defining an open central portion, and a U-shaped cross-section for fitting onto said rim, the U-shaped cross-section of the body defining a lower edge, and a pair of flanges, the pair of flanges completely seperate from each other, and extending inwardly from the body and adjacent the spout to prevent unwanted spillage of the material from the container as the material is poured out via the spout, wherein all parts of the device are located above a plane defined by the lower edge when the device is fitted onto the rim for use.

2. The device of claim 1 wherein the container has at least one longitudinal ridge extending outwardly near the rim, and the body of the device has a notch on one side corresponding in position with the ridge on the container, the ridge and the notch mating when the device is placed onto the rim of the container, to secure the device in proper position on the rim during use.

3. The device of claim 1 wherein said pair of flanges is sized and shaped so as not to impede the introduction of materials into the container.

4. The device of claim 2 wherein said pair of flanges is sized and shaped so as not to impede the introduction of materials into the container.

5. The device of claim 1 wherein the container has a substantially circular rim and the body of the device is shaped as an arc of the circle.

6. The device of claim 5 wherein a flange extends from the body on each side of and adjacent the spout.

7. The device of claim 6 wherein each flange has an outer edge that is arcuate.

8. The device of claim 1 further comprising a cut-out area formed at a back edge thereof, the cut-out area shaped to allow the device to fit around a handle of the container.

9. The device of claim 8 wherein the container is a blender cup.

10. The device of claim 1 wherein the device is free of holes completely surrounded by a material from which the device is constructed.

11. A device for preventing unwanted spillage of material as it is poured from a container that has an upper rim and a spout, comprising a body having the general shape of the rim and defining an open central portion, and a U-shaped cross-section for fitting onto said rim, and a plurality of flanges, completely seperated by an open space between them, extending inwardly from the body and adjacent the spout to prevent unwanted spillage of the material from the container as the material is poured out via the spout, the device having a height so as to be spaced from the material in the container when the device is configured for use, and the container is substantially full of material and the container is in an upright position.

12. A device for preventing unwanted spillage of material as it is poured from a container that has an upper rim and a spout, comprising a body having the general shape of the rim and defining an open central portion, and a U-shaped cross-section for fitting onto said rim, and a pair of flanges, completely separated by the opening, extending inwardly from the body and adjacent the spout to prevent unwanted spillage of the material from the container as the material is poured out via the spout, wherein said device is constructed and arranged to fit onto the rim of the container in a configuration for use without dividing an interior area of the container into plural sections.

* * * * *

UNITED STATES PATENT AND TRADEMARK OFFICE

CERTIFICATE OF CORRECTION

PATENT NO. : 7,766,185 B2
APPLICATION NO. : 11/599822
DATED : August 3, 2010
INVENTOR(S) : Michael J. Herbert It is certified that error appears in the above-identified patent and that said Letters Patent is hereby corrected as shown below:

Column 1, line 67, "along the line 10-10 of FIG. 2." should be changed to --along the line 9-9 of FIG. 2.--

Column 2, line 61, "underside of the device is about l/8$^{th}$ inch wide and 3/8ths" should be changed to --underside of the device is about l/8th inch wide and 3/8ths--

Signed and Sealed this

Twenty-first Day of September, 2010

David J. Kappos

David J. Kappos
*Director of the United States Patent and Trademark Office*